US006544597B2

(12) United States Patent
Takahashi et al.

(10) Patent No.: US 6,544,597 B2
(45) Date of Patent: Apr. 8, 2003

(54) MIXED POWDER THERMAL SPRAYING METHOD

(75) Inventors: Tadashi Takahashi, Hamamatsu (JP); Seiya Kunioka, Hamamatsu (JP); Kenji Miyai, Hamamatsu (JP)

(73) Assignee: Suzuki Motor Corporation (JP)

( * ) Notice: Subject to any disclaimer, the term of this patent is extended or adjusted under 35 U.S.C. 154(b) by 0 days.

(21) Appl. No.: 09/884,845

(22) Filed: Jun. 19, 2001

(65) Prior Publication Data

US 2002/0018858 A1 Feb. 14, 2002

(30) Foreign Application Priority Data

Jun. 21, 2000 (JP) ..... 2000-185541

(51) Int. Cl.[7] ..... C23C 4/12

(52) U.S. Cl. ..... 427/452; 427/446; 427/455; 427/456

(58) Field of Search ..... 427/446, 455, 427/456, 452; 239/80, 79; 219/76.16

(56) References Cited

U.S. PATENT DOCUMENTS

| | | | | |
|---|---|---|---|---|
| 4,696,855 A | * | 9/1987 | Pettit, Jr. et al. | 427/426 |
| 5,217,746 A | * | 6/1993 | Lenling et al. | 427/450 |
| 5,780,116 A | * | 7/1998 | Sileo et al. | 427/456 |

FOREIGN PATENT DOCUMENTS

| | | |
|---|---|---|
| JP | 04066656 A | 3/1992 |
| JP | 08167497 A | 6/1996 |
| JP | 11264061 A | 9/1999 |

* cited by examiner

*Primary Examiner*—Katherine A. Bareford
(74) *Attorney, Agent, or Firm*—Myers Bigel Sibley & Sajovec

(57) ABSTRACT

A mixed powder thermal spraying method includes forming a mixed thermal spraying film comprising two kinds of materials having different melting points wherein powder-feeding points are provided for each material; and each powder-feeding port is controlled respectively to externally feed each material, and wherein the thermal powder spraying method is bore thermal spraying carried out with a bent plasma jet.

8 Claims, 8 Drawing Sheets

MIXED POWDER THERMAL SPRAYING METHOD

CROSS-REFERENCE TO RELATED APPLICATIONS

The present application claims priority to Japanese Patent Application No. 2000-185541 filed Jun. 21, 2000, the disclosure of which is incorporated by reference herein in its entirety.

BACKGROUND OF THE INVENTION

The present invention relates to a mixed powder thermal spraying method, specifically to a mixed powder thermal spraying method in which a plasma jet is bent to carry out thermal spraying.

Techniques such as thermal spraying are widely used for sliding parts of cars as a method for providing sliding faces thereof with an abrasion resistance, and materials used for thermal spraying range over various fields from single materials to mixed (or combined) materials according to uses. Among them, a plasma thermal spraying gun for a bore is used when carrying out bore plasma thermal spraying as is the case with a bore internal surface for a cylinder block, and a structure of the plasma thermal spraying gun includes a system in which a plasma jet generated between an anode and a cathode is bent to an extension direction of the gun and thermally sprayed (FIG. 11) and a system in which a plasma jet is generated vertically to an extension direction of the gun according to arrangement of an anode and a cathode (FIG. 12).

An internal feeding method (a method in which powder is fed in the inside of a thermal spraying electrode) in which as shown in FIG. 11, powder 108 fed from a powder-feeding tube 106 passes through a powder-feeding passage 107 (pore) disposed in a copper alloy-made anode 102 and is fed to a plasma jet 104 from a feeding port 107*a* has so far been carried out as a method for feeding a powder material to a thermal spraying gun 101 having a system of bending a plasma jet.

When feeding a powder material by the system of FIG. 11, particles molten by the plasma jet 104 pass through the anode in the form of a thermal spraying flame 105, so that the molten particles 109 adhere to the inside of the anode (particularly the vicinity of a plasma jet injection port) in passing. If continuing thermal spraying as it is, adhesion of the molten particles 109 is expanded and comes to fill up the feeding port 107*a,* and the problem of clogging with the powder is brought about. Further, thermal spraying over a long period of time causes abrasion and deformation 107*b* of the powder-feeding passage 107 by virtue of flow of the powder. This causes turbulent flow in the powder-feeding passage 107 to reduce an injection speed of the powder, and therefore brought about is the problem that the molten particles 109 are liable to further adhere to the anode.

Accordingly, in such thermal spraying method, a frequency of maintenance of the thermal spraying gun against adhesion and clogging of the molten particles grows large, and the productivity is deteriorated. Further, when abrasion of the powder-feeding passage 107 is accelerated, the anode 102 has to be exchanged even if the anode 102 does not reach an intrinsic life. The anode 102 has a special shape and therefore is expensive, which has led to an increase in the product cost.

On the other hand, an external feeding method (a method in which powder is fed in the outside of the thermal spraying electrode) in which as shown in FIG. 12, powder 108 is fed to a resulting plasma jet 124 from a powder-feeding port 126*a* which is an outlet of a powder-feeding tube 126 has so far been carried out as a method for feeding a powder material to a thermal spraying gun 121 having a system in which a plasma jet is generated vertically to an extension direction of the gun.

In the system shown in FIG. 12, not only the thermal spraying distance is short as compared with the system shown in FIG. 11, but also the plasma output has had to be suppressed so that a heat effect is not exerted on an article to be processed. Accordingly, the plasma has a low output, and a very fine powder material has to be used in order to sufficiently melt and accelerate the powder material at a short thermal spraying distance, so that there have been the problems that the powder is increased in a cost and it is difficult to manage the powder. Further, the finer the powder is, the more the fluidity thereof is deteriorated, and therefore it is concerned that it becomes difficult to stably feed the powder.

In addition thereto, two kinds of the bore thermal spraying guns described above each have one powder-feeding port, and particularly when preparing a mixed thermal spraying film comprising two or more kinds of components, there has so far been employed, (1) a method in which plural powders to be used are mixed in advance and fed or (2) a method in which plural powders to be used are alloyed or combined (combination by mechanical alloy) in advance and fed.

In the method (1), it is difficult to continue feeding the mixed powders in an always fixed proportion. Further, there have been the problems that among the mixed powders, the powder having a lower melting point is molten before coming out from the powder-feeding port and liable to cause clogging and that if the plasma output is reduced in order to avoid it, the powder having a higher melting point is not sufficiently molten to reduce a quality of the thermal spraying film.

Further, in the method (2), there have so far been the problems that not only the powder cost is elevated but also alloying or combining is difficult because of the nature of the components of the material.

SUMMARY OF THE INVENTION

The present invention has been made in light of such existing situations, and an object thereof is to provide a mixed powder thermal spraying method in which an anode having a high durability and a low price can be used and a thermal spraying powder is easily managed and in which a thermal spraying film having a high quality is obtained.

In accordance with the present invention, there is provided a mixed powder thermal spraying method in which: a plasma jet is bent to carry out thermal spraying; in forming a mixed thermal spraying film comprising two kinds of materials having different melting points by bore thermal spraying, powder-feeding ports are provided for each material; and each powder-feeding port is controlled respectively to externally feed each material.

According to the method, the fed powder and the particles molten by a plasma jet do not pass through the inside of the anode, and therefore solved are the problems of adhesion of the molten particles to the anode, clogging of the fed powder caused by it and abrasion of a powder-feeding passage in the anode which have so far been brought about in conventional techniques. Accordingly, maintenance of the anode can be freed, and a life of the anode is extended. Further, the structure of the anode is simplified, so that the anode is decreased in a cost. Thus, the thermal spraying method which is excellent in a mass productivity and a maintenance can be provided at a low cost.

Further, the powder-feeding tube is a separate member, so that the feeding conditions are separately controlled in such a manner that the position of the feeding port can freely be set up, whereby the feeding conditions suited to the respective materials can be set up. A mixed proportion in the thermal spraying film can always constantly be maintained, and therefore a quality of the thermal spraying film is stabilized and elevated. Further, even if the powder-feeding tube is clogged, only the feeding tube can readily be exchanged.

To perform the mixed powder thermal spraying method in accordance with the present invention, it is advantageous to feed externally a material having a higher melting point from a thermal spraying flame high temperature part side and to feed externally a material having a lower melting point from a thermal spraying flame low temperature part side.

The plasma jet generated between the anode and the cathode in plasma thermal spraying stays in a very high temperature area. The powder is molten by the plasma jet, and the molten particles thereof form a thermal spraying flame. In thermal spraying, in order to efficiently melt the powder fed to form a thermal spraying film having less defects such as voids and a good quality, it is important to feed as much powder as possible to the plasma jet and apply sufficient heat to the powder. This requires to allow the powder-feeding port to be close to the plasma jet as much as possible to feed the powder. Supposing that the feeding port is kept away from the plasma jet, the powder injected from the feeding port spreads immediately after injected, so that the powder is less liable to reach the plasma jet and is not sufficiently heated and molten. As a result thereof, defects such as voids, inferior melting and inferior mixing are brought about in the film formed or brought about is the problem of a reduction in a yield (adhesion efficiency) of the powder, in which an amount of the powder introduced into the film is decreased as compared with the powder fed.

The present inventors have confirmed that in a bore plasma thermal spraying method in which a plasma jet is bent, the plasma jet after bent and the thermal spraying flame stay in a state in which the plasma jet is deviated and that a high temperature part and a low temperature part are present in the thermal spraying flame.

In this case, the powder-feeding port positioned in the high temperature part side of the thermal spraying flame is liable to be elevated to a high temperature, and when a material having a low melting point is fed to the plasma jet from the high temperature part side of the thermal spraying flame, the powder is molten at a temperature of the heated feeding port and clogs the vicinity of the feeding port, so that clogging is caused, and maintenance thereof is required. If the feeding port is kept away from the thermal spraying flame as a countermeasure therefor, a film having a good quality is not obtained as described above.

On the other hand, as shown in this embodiment, the powder material can sufficiently be molten by feeding the material having a high melting point from the powder-feeding tube in a high temperature part side of the thermal spraying flame to the plasma jet. Further, feeding of the material having a low melting point from the powder-feeding tube in a low temperature part side of the thermal spraying flame to the plasma jet makes it possible to bring the powder-feeding port close to the plasma jet while preventing clogging in the powder-feeding port, and therefore a thermal spraying film in which a melting state and a mixed proportion of the powder are stabilized and which has a good quality can be produced free of maintenance as well in mass production.

In the present invention, it is advantageous to set up $0° \leqq \alpha_1$ and $0° \leqq \alpha_2$, wherein $\alpha_1$ is an angle made by an injection direction of the powder fed from the thermal spraying high temperature part side to the plasma jet and a plasma jet-injecting face of an anode in a thermal spraying gun body, and $\alpha_2$ is an angle made by an injection direction of the powder fed from the thermal spraying low temperature part side to the plasma jet and the plasma jet-injecting face of the anode in the thermal spraying gun body.

With these features, $0° \leqq \alpha_1$ and $0° \leqq \alpha_2$ are set up, so that the particles do not adhere to the plasma-injecting face or the injection port in the anode, and the anode is free of maintenance. In this case, the powder fed is preferably brought close to the plasma jet-injecting port in order to sufficiently melt the powder, and as $\alpha_1$ and $\alpha_2$ grow large, the powder is less liable to be introduced into the plasma jet, so that the powder is insufficiently molten, and the yield is deteriorated. Accordingly, $0° \leqq \alpha_1 \leqq 45°$ and $0° \leqq \alpha_2 \leqq 45°$ are more preferred in order to prepare a film which is stable and has a good quality.

In the present invention, it is advantageous that another powder-feeding port is not present on an extension of the injection direction of the powder fed.

With this feature, another powder-feeding port is not present on an extension of the injection direction of the powder fed, so that the particles passing through the plasma jet and the flame do not adhere to the another powder-feeding port, and clogging is not brought about. Accordingly, the powder can continuously be fed free of maintenance.

In the present invention, it is advantageous that the material having a higher melting point is an Fe base material, and the material having a lower melting point is an Al base material and that the Fe base material is externally fed from the high temperature part side of the thermal spraying flame is externally fed to the plasma jet and the Al base material is externally fed from the low temperature part side of the thermal spraying flame to the plasma jet.

When a mixed powder of an Fe base material and an Al base material is thermally sprayed, they have so far been mixed or combined in advance, and in this case, the problems described in Prior Art have been brought about.

In the mixed powder thermal spraying method of the present invention, the Fe base material is fed to the plasma high temperature part, and therefore the Fe base material can sufficiently be molten. Further, the Al base material is fed to the plasma low temperature part, and therefore the Al base material can be prevented from being molten in the powder-feeding port more than required to bring about clogging.

Accordingly, the Fe base material and the Al base material can be fed on feeding conditions which are suited respectively to them, and therefore an Fe based-Al base mixed film in which the respective materials are sufficiently molten and mixed and which has a good quality can be prepared. Further, they are not mixed in the form of powders, so that an industrially special technique is not required, and it can be produced at a low cost.

The Fe base material includes, to be specific, white cast iron, carbon steel, Fe—Mo base alloy, Fe—Cr base alloy and Fe—Ni base alloy, and the Al base material includes, to be specific, Al—Si base alloy, Al—Pb base alloy, Al-bronze alloy, Al—Cu base alloy and pure Al.

BRIEF DESCRIPTION OF THE DRAWINGS

The mixed powder thermal spraying method of the present invention will be explained with reference to the drawings.

DETAILED DESCRIPTION OF THE PREFERRED EMBODIMENTS

Figure 1:
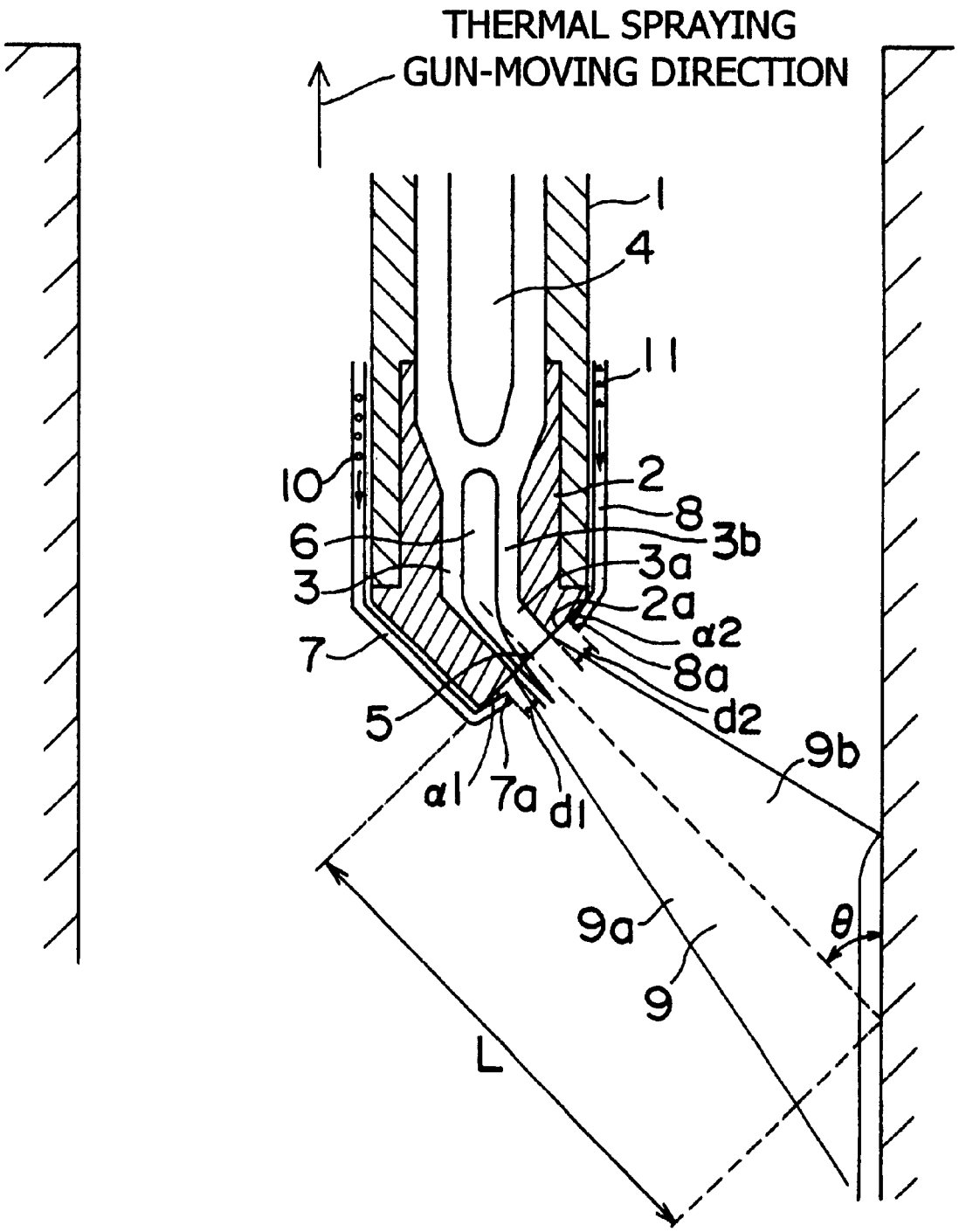
FIG. 1 shows one embodiment of a bore thermal spraying gun for carrying out the mixed powder thermal spraying method according to the present invention and is a cross section showing schematically an essential part thereof.

FIG. 1 is a schematic cross section showing an essential part of a bore plasma thermal spraying gun for carrying out an embodiment of the mixed powder thermal spraying method according to the present invention.

In this bore plasma thermal spraying gun, an anode 2 is disposed in a tip part of a thermal spraying gun body 1. This anode 2 has a plasma jet passage 3 in an axial core part, and a cathode 4 is disposed in the inner part of the above plasma jet passage 3. A tip passage 3*a* in the vicinity of an injection port 5 in the plasma jet passage 3 is bent to a base passage 3*b,* and an axial core of the above passage 3*a* is formed inclining to an axial core of the base passage 3*b* by almost 45°. A plasma jet 6 is formed in a plasma jet passage 3 by the anode 2 and the cathode 4.

In this bore plasma thermal spraying gun, two powder-feeding tubes 7, 8 are disposed in a circumferential surface of the thermal spraying gun body 1. A feeding port 7*a* of the powder-feeding tube 7 is turned toward a high temperature part 9*a* of a thermal spraying flame 9 formed by a plasma jet 6, and a feeding port 8*a* of the powder-feeding tube 8 is turned toward a low temperature part 9*b* of the thermal spraying flame 9. In this bore plasma thermal spraying gun, $0° \leqq \alpha_1 \leqq 45°$ and $0° \leqq \alpha_2 \leqq 45°$ are set up, wherein $\alpha_1$ is an angle made by an injection direction of the powder fed from the feeding port 7*a* to the high temperature part 9*a* of the thermal spraying flame 9 and a plasma jet-injecting face 2*a* of the anode 2 in the thermal spraying gun body 1, and $\alpha_2$ is an angle made by an injection direction of the powder fed from the feeding port 8*a* to the low temperature part 9*b* of the thermal spraying flame 9 and the plasma jet-injecting face 2*a* of the anode 2 in the thermal spraying gun body 1.

In the bore plasma thermal spraying gun thus structured, two kinds of powders having different melting points, for example, an Fe base material powder 10 having a high melting point and an Al base material powder 11 having a low melting point each are separately controlled and fed to the plasma jet 6 from the powder-feeding ports 7*a,* 7*b* of the powder-feeding tubes 7, 8 in a position where the plasma jet 6 comes out from the injection port 5. Then, the powder fed to the plasma jet 6 is molten, and the thermal spraying flame 9 is formed by the molten particles.

According to this embodiment, the fed powder and the particles molten by the plasma jet 6 do not pass through the anode 2, and therefore solved are the problems such as adhesion of the molten particles to the anode 2, clogging of the fed powder caused by it and abrasion of the powder-feeding passage in the anode which has so far been observed.

On the other hand, it is important in order to efficiently melt the fed powder to form a good thermal spraying film having less defects such as voids to feed as much powder as possible to the plasma jet 6 and apply sufficient heat to the powder. This requires to feed the powder bringing the powder-feeding ports 7*a,* 8*a* close to the plasma jet 6 as much as possible. If the powder-feeding ports 7*a,* 8*a* are kept away from the plasma jet 6, the powders injected from the powder-feeding ports 7*a,* 8*a* spread from immediately thereafter, so that they are less liable to reach the plasma jet 6, and the powders are not sufficiently heated and molten. As a result thereof, defects such as voids, inferior melting and inferior mixing are brought about in the film formed or brought about is the problem of a reduction in a yield (adhesion efficiency) of the powder, in which an amount of the powder introduced into the film is decreased as compared with the powder fed.

Figure 2:
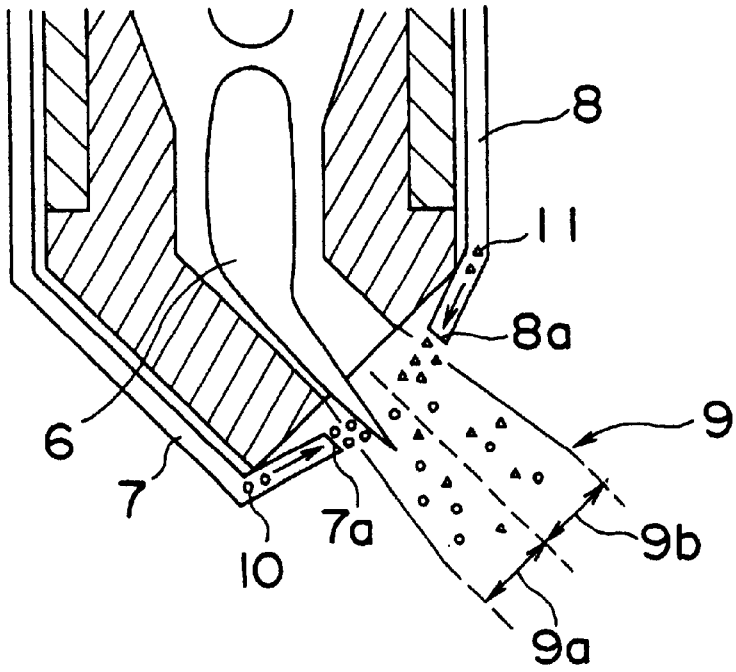
FIG. 2 is a cross section showing the enlarged bore thermal spraying gun shown in FIG. 1.

The present inventors have confirmed that in a bore plasma thermal spraying method in which a plasma jet is bent, the plasma jet 6 after bent and the thermal spraying flame 9 stay in a state in which the plasma jet 6 is deviated as shown in FIG. 2 enlarged and that the high temperature part 9*a* and the low temperature part 9*b* are present in the thermal spraying flame 9.

In this case, the powder-feeding port 7*a* positioned in the high temperature part 9*a* side of the thermal spraying flame 9 is liable to be elevated to a high temperature, and when a material having a low melting point is fed from the low temperature part 9*b* side of the thermal spraying flame 9, the powder is molten at a temperature of the heated feeding port 7*a* and covers the vicinity of the feeding port 7*a,* so that clogging is caused, and maintenance is required. If the feeding port 7*a* is kept away from the thermal spraying flame 9 as a countermeasure therefor, a film having a good quality is not obtained as described above.

On the other hand, as shown in this embodiment (refer to FIG. 2), the powder material can sufficiently be molten by feeding the material having a high melting point from the powder-feeding tube 7 in the high temperature part 9*a* side of the thermal spraying flame 9. Further, feeding of the material having a low melting point from the powder-feeding tube 8 in the low temperature part 9*b* side of the thermal spraying flame 9 makes it possible to bring the powder-feeding port 8*a* close to the plasma jet 9 while preventing clogging in the powder-feeding port 8*a,* and therefore a thermal spraying film in which a melting state and a mixed proportion of the powder are stabilized and which has a good quality can be produced free of maintenance as well in mass production.

In plasma thermal spraying, when feeding the powder to the plasma jet 6, the particles molten by the plasma jet 6 correct usually a flight orbit along an injection direction of the plasma jet 6 to form the thermal spraying flame 9, but present is a part of the particles which pass through the plasma jet 6 and the thermal spraying flame 9 in the injected direction without correcting the orbit. In this case, if the plasma jet-injection face 2*a* or injection port 5 of the anode 2 is present on an extension of the injection direction of the powder, the molten particles adhere to the injection face 2*a* or the injection port 5, and further they cause clogging. Accordingly, this requires maintenance of the anode 2 and becomes a cause of shortening a life of the anode.

In this embodiment, $0° \leqq \alpha_1$ and $0° \leqq \alpha_2$ are set up, so that the particles do not adhere to the plasma injection face 2*a* or the injection port 5 of the anode 2, and the anode is free of maintenance. In this case, the powder fed is preferably brought close to the plasma jet injection port 5 in order to sufficiently melt the powder, and as $\alpha_1$ and $\alpha_2$ grow large, the powder is less liable to be introduced into the plasma jet, so that the powder is insufficiently molten, and the yield is deteriorated. Accordingly, $0° \leqq \alpha_1 \leqq 45°$ and $0° \leqq \alpha_2 \leqq 45°$ are more preferred in order to prepare a film which is stable and has a good quality.

In this embodiment, another powder-feeding port is not present on an extension of the injection direction of the powder fed, so that the particles passing through the plasma jet 6 and the thermal spraying flame 9 do not adhere to the powder-feeding ports 7*a,* 8*a,* and clogging is not brought about. Accordingly, the powder can continuously be fed free of maintenance.

When a mixed powder of an Fe base material and an Al base material is thermally sprayed, they have so far been mixed or combined in advance, and in this case, the problems described in Prior Art have been brought about. In particular, as symbolized by a thermit reaction, the Fe base material is liable to be reacted with the Al base material, and there is a risk of explosion, so that close attentions are paid to handling thereof.

In this embodiment, the Fe base material is fed from the high temperature part 9*a* side of the thermal spraying flame 9, whereby the Fe base material can sufficiently be molten. The Al base material is fed from the low temperature part 9*b* side of the thermal spraying flame 9 to the plasma jet 6, whereby the Al base material is prevented from being molten in the powder-feeding port 8*a* more than required to bring about clogging. Accordingly, the Fe base material and the Al base material can be fed on feeding conditions which are suited respectively to them, and therefore an Fe base-Al base mixed film in which the respective materials are sufficiently molten and mixed and which has a good quality can be prepared. Further, they are not mixed in the form of powders, so that an industrially special technique is not required, and it can be produced at a low cost.

The Fe base material includes, to be specific, white cast iron, carbon steel, Fe—Mo base alloy, Fe—Cr base alloy and Fe—Ni base alloy, and the Al base material includes, to be specific, Al—Si base alloy, Al—Pb base alloy, Al-bronze alloy, Al—Cu base alloy and pure Al.

WORKING EXAMPLE

In the following examples and comparative examples, continuous thermal spraying experiments were carried out, and the quality was confirmed by producing the samples.

In a bore thermal spraying method in which a plasma jet is bent, the continuous thermal spraying experiments were carried out on conditions shown in the following Table 1. The continuous thermal spraying experiment is an experiment in which assuming mass production, a plasma jet and fed powder are continued to be injected to confirm a durability of a thermal spraying gun and a possibility of troubles. In this case, the continuous injection time was set to 180 minutes.

TABLE 1

| Continuous thermal spraying experiment conditions | |
|---|---|
| Current fed | 800 A |
| Active gas flow amount (Ar) | 56.8 liter/min |
| Auxiliary gas flow amount (He) | 7.6 liter/min |
| Thermal spraying angle θ | 45° |
| Continuous injection time | 180 min |

Further, a mixed thermal spraying film was formed on an internal surface of a cylindrical test piece to prepare a sample for confirming a film quality. Used for thermal spraying materials were a carbon steel powder having a particle diameter of 10 to 105 μm as an Fe base material and an Al—Si base alloy powder having a particle diameter of 10 to 105 μm as an Al base material. The thermal spraying conditions are shown in Table 2.

TABLE 2

| Thermal spraying conditions for preparing samples | |
|---|---|
| Current fed | 800 A |
| Active gas flow amount (Ar) | 56.8 liter/min |
| Auxiliary gas flow amount (He) | 7.6 liter/min |
| Thermal spraying angle θ | 45° |
| Thermal spraying gun traverse speed | 200 mm/sec |
| Thermal spraying pitch | 2 mm |
| Thermal spraying distance L | 42 mm |

EXAMPLE 1

The bore thermal spray gun of a two line external feeding system (FIG. 1) of the present invention was used to feed a carbon steel powder from the high temperature part 9*a* side of the thermal spraying flame 9 and an Al—Si base alloy powder from the low temperature part 9*b* side of the thermal spraying flame 9 on conditions shown in Table 3 (fed in a proportion of 80 wt % of the carbon steel powder (about 60 vol %)-20 wt % of the Al—Si base alloy powder (about 40 vol %)), and a continuous thermal spraying experiment was carried out. In this case, a distance $d_1$ between the powder-feeding port 7*a* in the high temperature part 9*a* side of the thermal spraying flame 9 and the plasma jet injection port 5 and a distance $d_2$ between the powder-feeding port 8*a* in the low temperature part 9*b* side of the thermal spraying flame 9 and the plasma jet injection port 5 were set to $d_1$=2 mm and $d_2$=2 mm respectively. Sample 1 was prepared on the same conditions.

TABLE 3

| Powder feeding conditions 1 | | |
|---|---|---|
| | Powder-feeding gas flow amount | Powder-feeding Amount |
| Carbon steel powder | 4.5 liter/min | 26 g/min |
| Al-Si alloy powder | 4.5 liter/min | 7 g/min |

Figure 4:
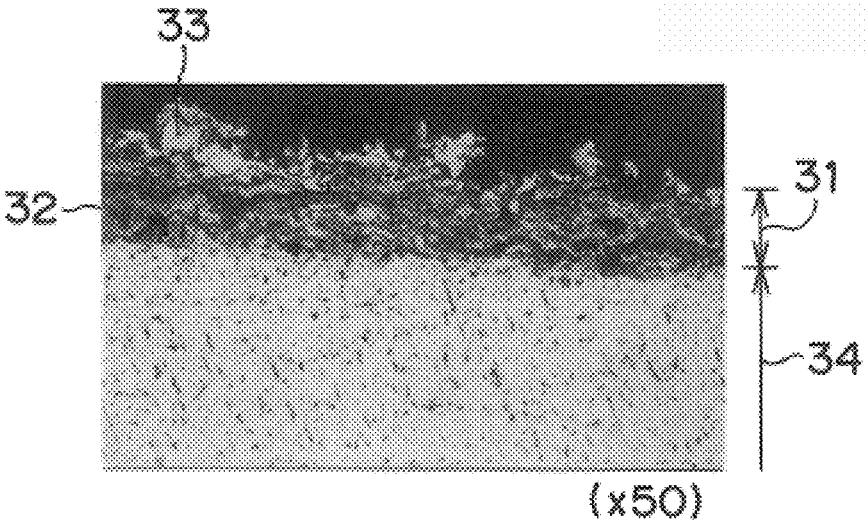
FIG. 4 is a photograph showing a cross section of the thermal spraying film formed by the bore thermal spraying gun for carrying out the mixed powder thermal spraying method according to the present invention.

A film cross-sectional photograph of Sample 1 is shown in FIG. 4. In this film cross-sectional photograph, a black part of a thermal spraying film 31 is formed out of carbon steel 32, and a white part thereof is formed out of an Al—Si base alloy part 33. The film cross-sectional photograph was photographed by polishing the sample and then etching it by means of a nital.

In the continuous thermal spraying experiment described above, adhesion and clogging of the molten particles were not observed on the anode even in 180 minutes after continuous thermal spraying. Further, it can be found from the film cross-sectional photograph of Sample 1 shown in FIG. 4 that a melting state and a mixing state of the respective materials are good and the minute thermal spraying film is formed.

COMPARATIVE EXAMPLE 1

Figure 11:
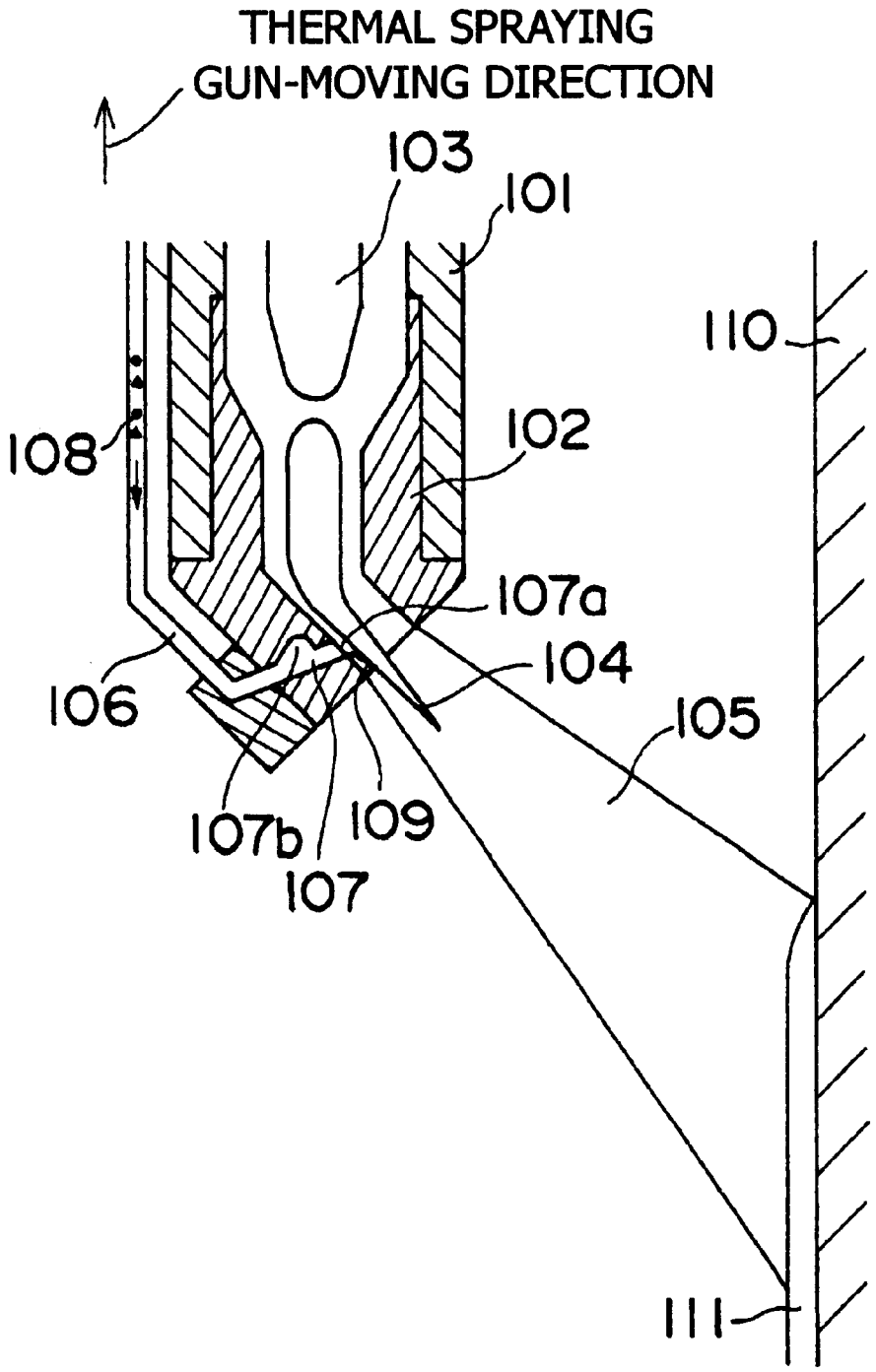
FIG. 11 (RELATED ART)
FIG. 11 is an essential part cross section schematically showing a conventional bore thermal spraying gun of an internal feeding system.
Figure 12:
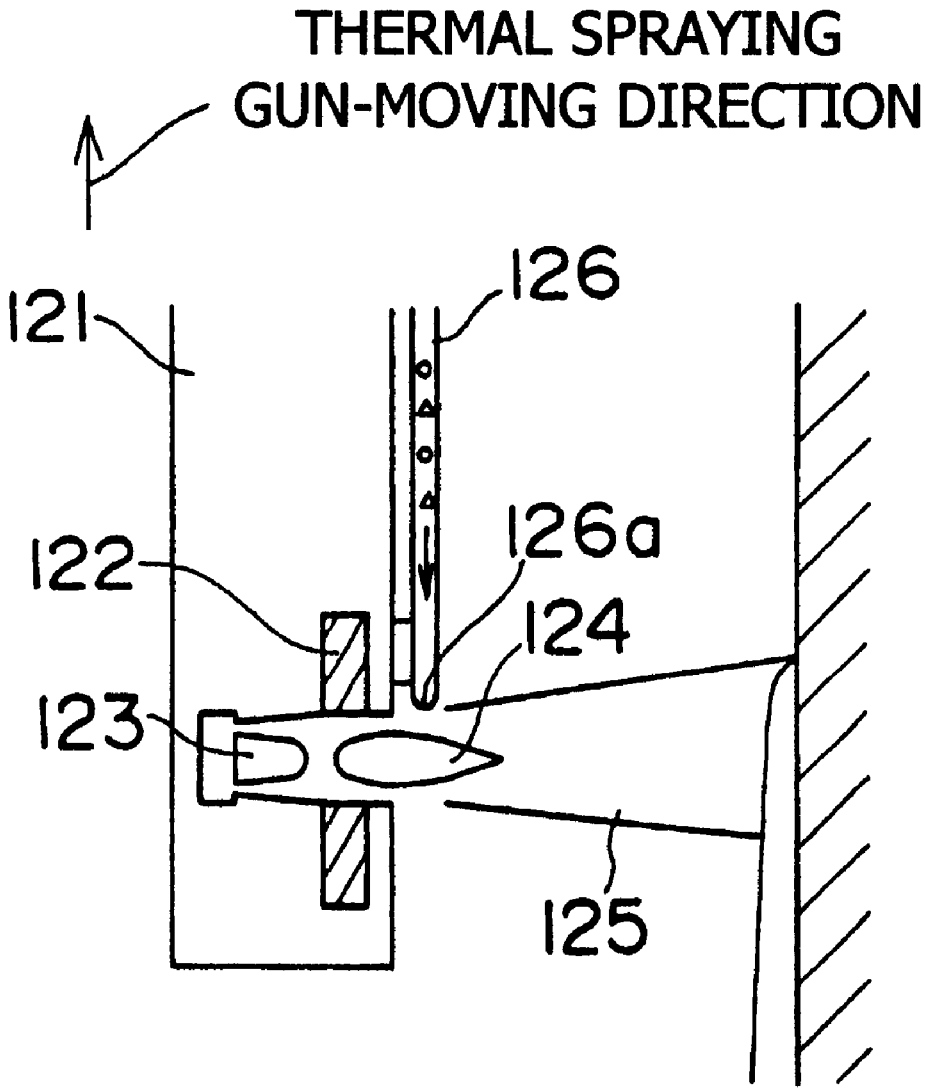
FIG. 12 (RELATED ART)
FIG. 12 is an essential part cross section schematically showing a conventional thermal spraying gun of a system in which a plasma jet is generated vertically to an extension direction of the gun.

A conventional bore thermal spray gun of an internal feeding system (FIG. 11) was used to carry out a continuous thermal spraying experiment. The powders described above were used for powders to be fed, and used was powder prepared by mixing them in advance so that 80 wt % of the carbon steel powder (about 60 vol %)-20 wt % of the Al—Si base alloy powder (about 40 vol %) was obtained. The powder feeding conditions are shown in Table 4.

TABLE 4

| Powder feeding conditions 2 | | |
|---|---|---|
| | Powder-feeding gas flow amount | Powder-feeding amount |
| Mixed powder | 5.3 liter/min | 33 g/min |

In this continuous thermal spraying experiment, clogging in a feeding passage caused by adhesion of the molten particles in the anode was generated after 20 minutes since starting the continuous thermal spraying experiment, and therefore the continuous thermal spraying experiment was discontinued. Thereafter, the continuous thermal spraying experiment was continued while carrying out maintenance of the anode. After 180 minutes, clogging came to be generated at intervals of about 10 minutes. A cross-sectional photograph of the anode 41 after used for 180 minutes is shown in FIG. 5.

Figure 5:
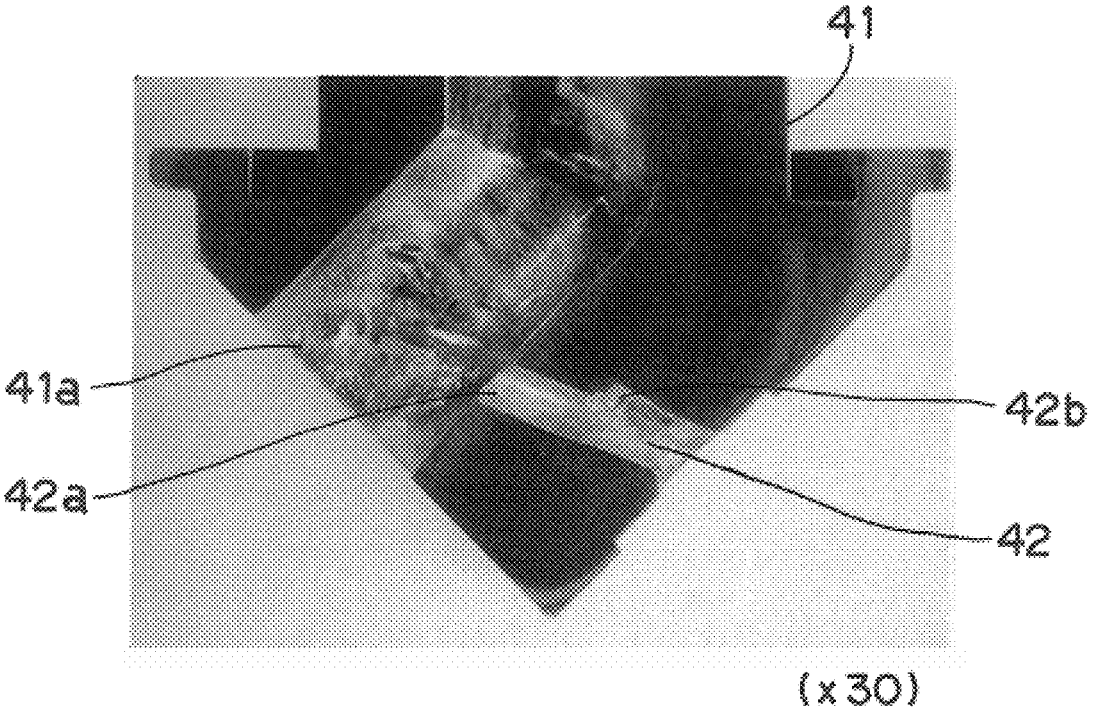
FIG. 5 is a cross-sectional photograph showing a result obtained by carrying out the comparative example on the same conditions as in the present invention by means of a conventional thermal spraying gun of an internal feeding system in order to compare it with the mixed powder thermal spraying method according to the present invention.

In this continuous thermal spraying experiment, it can be found that in FIG. 5, a powder-feeding passage 42 is deformed 42*b* by abrasion. This made it difficult for the powder to be smoothly injected from a feeding port 42*a,* so that the molten particles were liable to adhere to the anode, and it was clogged by the powder. Thus, if the powder-feeding passage is abraded and deteriorated, it stays in a state in which clogging is liable to be generated after that, so that the anode has to be exchanged.

COMPARATIVE EXAMPLE 2

The bore thermal spray gun of an external feeding system (FIG. 1) of the present invention was used to carry out a continuous thermal spraying experiment. In Comparative Example 2, the same mixed powder as in Comparative Example 1 was used, and one line out of the two line external feeding system of the present invention was used.

In Comparative Example 2-1, the mixed powder was fed only from the high temperature part 9*a* side of the thermal spraying flame 9 on the conditions shown in Table 4 to carry out continuous thermal spraying. First, $d_1$=2 mm was set up. After 8 minutes since starting the continuous thermal spraying experiment, clogging was brought about at the feeding port 7*a* of the powder-feeding tube 7.

This is because the powder was molten in the heated feeding port 7*a,* and a result obtained by analyzing the molten substance showed that almost all of it was Al—Si alloy having a low melting point.

Figure 6:
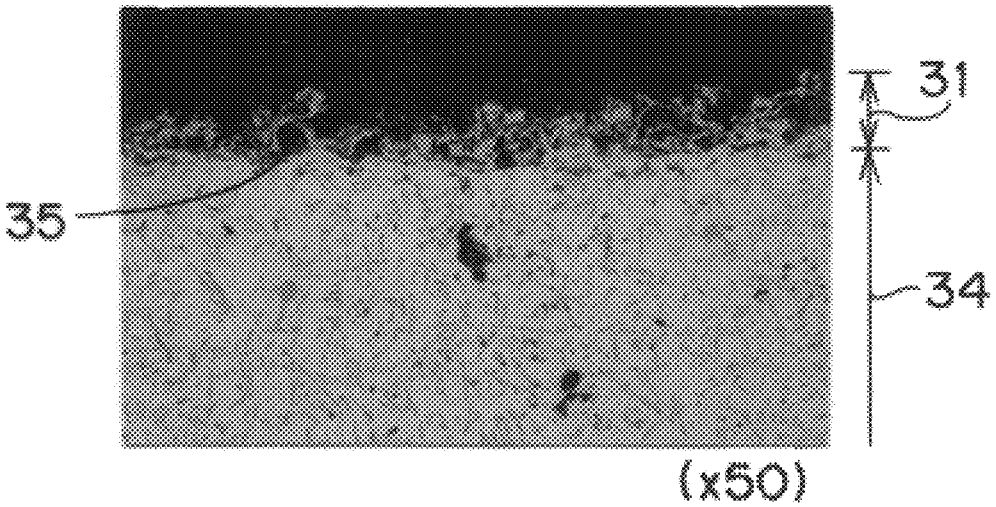
FIG. 6 is a thermal spraying film cross-sectional photograph of the sample obtained when using the bore thermal spraying gun for carrying out the mixed powder thermal spraying method according to the present invention to feed the mixed powder only from the high temperature part side of the thermal spraying flame out of the two line external feeding system.

Then, $d_1$ was increased, and a continuous thermal spraying test was carried out at $d_1$=5 mm to prepare Sample 2. A film cross-sectional photograph of Sample 2 is shown in FIG. 6. Clogging was not caused even after 180 minutes, but a film thickness of the thermal spraying film was about half as compared with the case of $d_1$=2 mm. This is because the powder which was introduced into the plasma jet and molten was decreased and a yield (adhesion efficiency) of the powder was deteriorated. Further, a lot of defects such as voids and unmolten particles 35 were observed in the film.

Figure 7:
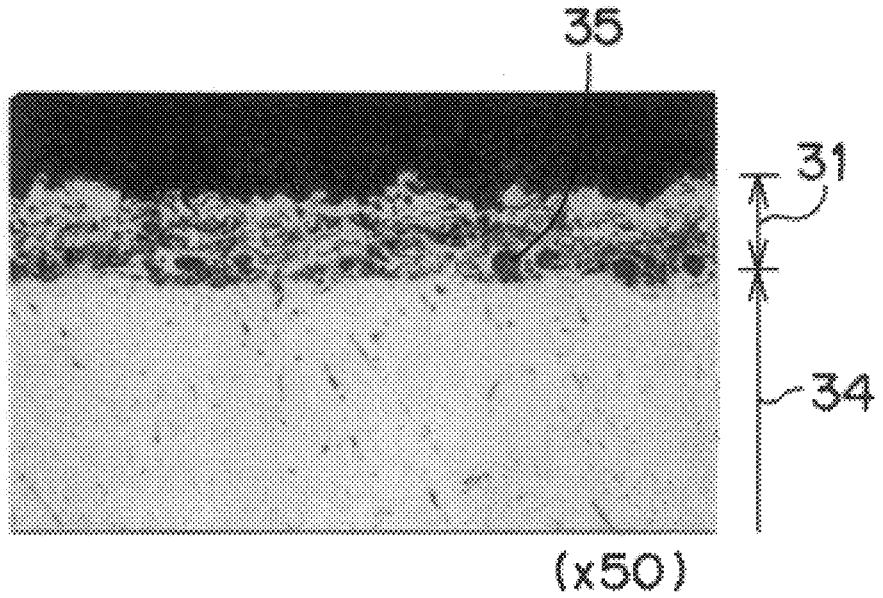
FIG. 7 is a thermal spraying film cross-sectional photograph of the sample obtained when using the bore thermal spraying gun for carrying out the mixed powder thermal spraying method according to the present invention to feed the mixed powder only from the low temperature part side of the thermal spraying flame out of the two line external feeding system.

In Comparative Example 2-2, the mixed powder was fed only from the low temperature part 9*b* side of the thermal spraying flame 9 on the conditions shown in Table 4, and a continuous thermal spraying test was carried out to prepare Sample 3. In this case, $d_2$=2 mm was set up. A film cross-sectional photograph of Sample 3 is shown in FIG. 7.

In this thermal spraying experiment, clogging was not brought about even after 180 minutes, but a mixing proportion of the carbon steel was small as compared with that of Sample 1.

This is due to that the mixed powder was fed from the low temperature side, so that the carbon steel powder having a high melting point was not sufficiently molten and less particles were introduced into the film. Even if introduced, a lot of spherical unmolten particles were observed. On the other hand, a melting state of the Al—Si alloy was good.

COMPARATIVE EXAMPLE 3

The bore thermal spray gun of a two line external feeding system (FIG. 1) of the present invention was used to feed an Al—Si alloy powder from the high temperature 9*a* side of the thermal spraying flame 9 and a carbon steel powder from the low temperature 9*b* side of the thermal spraying flame 9 on the conditions shown in Table 3 to carry out a continuous thermal spraying experiment. In this case, $d_1$=2 mm and $d_2$=2 mm were set up.

After 7 minutes since starting the continuous thermal spraying experiment, the Al—Si alloy powder was molten in the inside of the feeding port 7*a* at the high temperature 9*a* side of the thermal spraying flame 9 as was the case with Comparative Example 2-1 to bring about clogging. Further, a yield of the carbon steel was deteriorated. It is considered to increase $d_1$ as a countermeasure for clogging, but a yield of the Al—Si alloy is deteriorated, so that it is not effective.

It can be found from Example 1 and Comparative Examples 1 to 3 that when mixed thermal spraying is carried out by means of a bore thermal spraying gun in which a plasma jet is bent, it is effective in terms of a film quality and a production thereof to externally feed the respective powders on optimum feeding conditions. In this case, it can be found that it is preferred to feed the powder having a high melting point from the high temperature 9*a* side of the thermal spraying flame 9 and the powder having a low melting point from the low temperature 9*b* side of the thermal spraying flame 9.

EXAMPLE 2

The bore thermal spray gun of a two line external feeding system (FIG. 1) of the present invention was used to feed a carbon steel powder from the high temperature 9*a* side of the thermal spraying flame 9 and an Al—Si alloy base powder from the low temperature 9*b* side of the thermal spraying flame 9 on the conditions shown in Table 3 to carry out a continuous thermal spraying experiment. In this case, $d_1$=2 mm and $d_2$=2 mm were set up.

Figure 3:
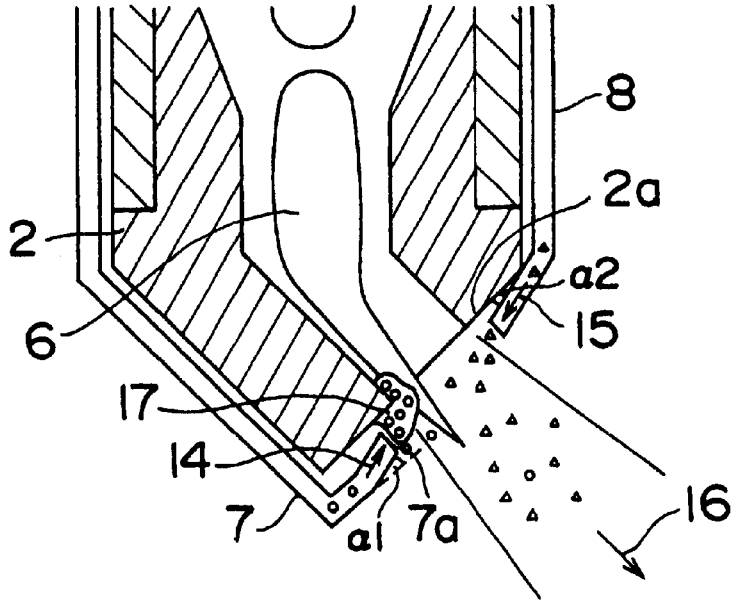
FIG. 3 shows a bore thermal spraying gun for comparing with the bore thermal spraying gun for carrying out the mixed powder thermal spraying method according to the present invention and is a schematic cross section showing the comparative example in which the powder-feeding port is disposed toward the anode side.

In Example 2-1, $\alpha_1$=−10° and $\alpha_2$=0° were set up, wherein $\alpha_1$=−10° shows that as is the case with a powder injection direction 14 from the high temperature 9*a* side of the thermal spraying flame 9 in FIG. 3, an injection direction of the powder-feeding port 7*a* is turned to an anode side inverse to a jet advancing direction 16 against the plasma jet injection face 2*b*.

After 40 minutes since starting the continuous thermal spraying experiment, a wall 17 of carbon steel-molten particles adhering to the anode was formed in front of the powder-feeding port 7*a* at the high temperature 9*a* side of the thermal spraying flame 9, and the powder-feeding port 7*a* was clogged. Such phenomenon was not observed at the low temperature 9*a* side of the thermal spraying flame 9, and it was found that $0° \leqq \alpha_1$ and $0° \leqq \alpha_2$ had to be set up in order to prevent the molten particles from adhering to the anode 2.

Figure 8:
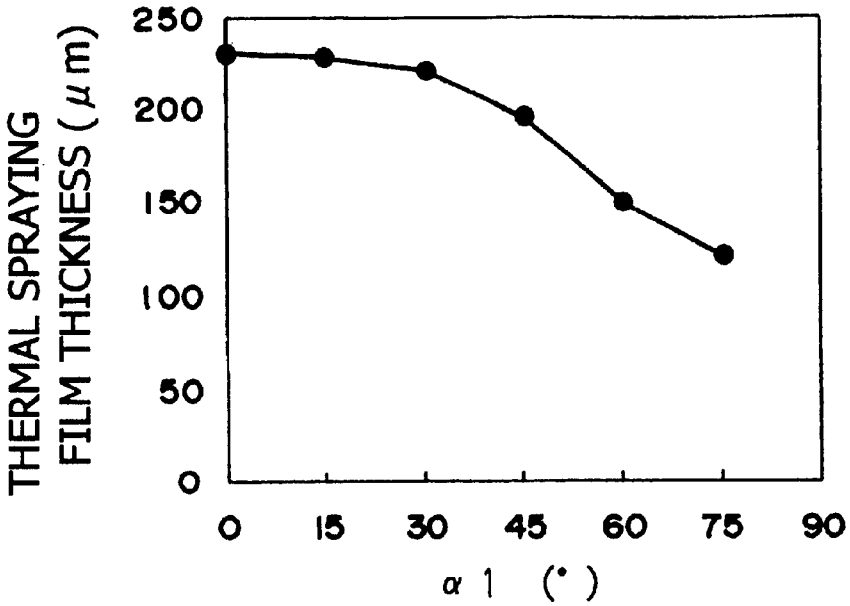
FIG. 8 is a graph showing a relation of the angle $\alpha_1$ made by an injection direction of the powder-feeding port and the plasma jet-injecting face of the anode with the thermal spraying film thickness.
Figure 9:
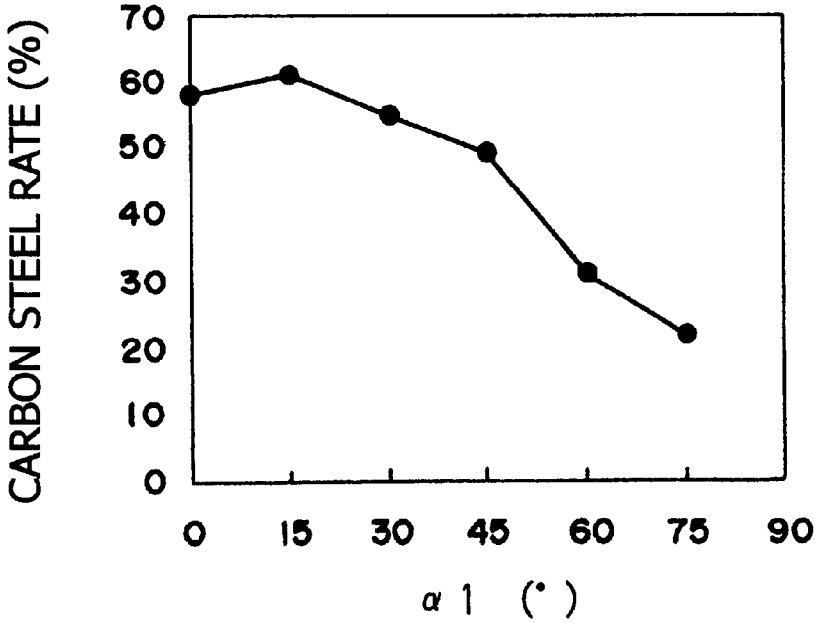
FIG. 9 is a graph showing a result obtained by determining a carbon steel rate in the film components by an area rate held by the carbon steel in a thermal spraying film cross section.
Figure 10:
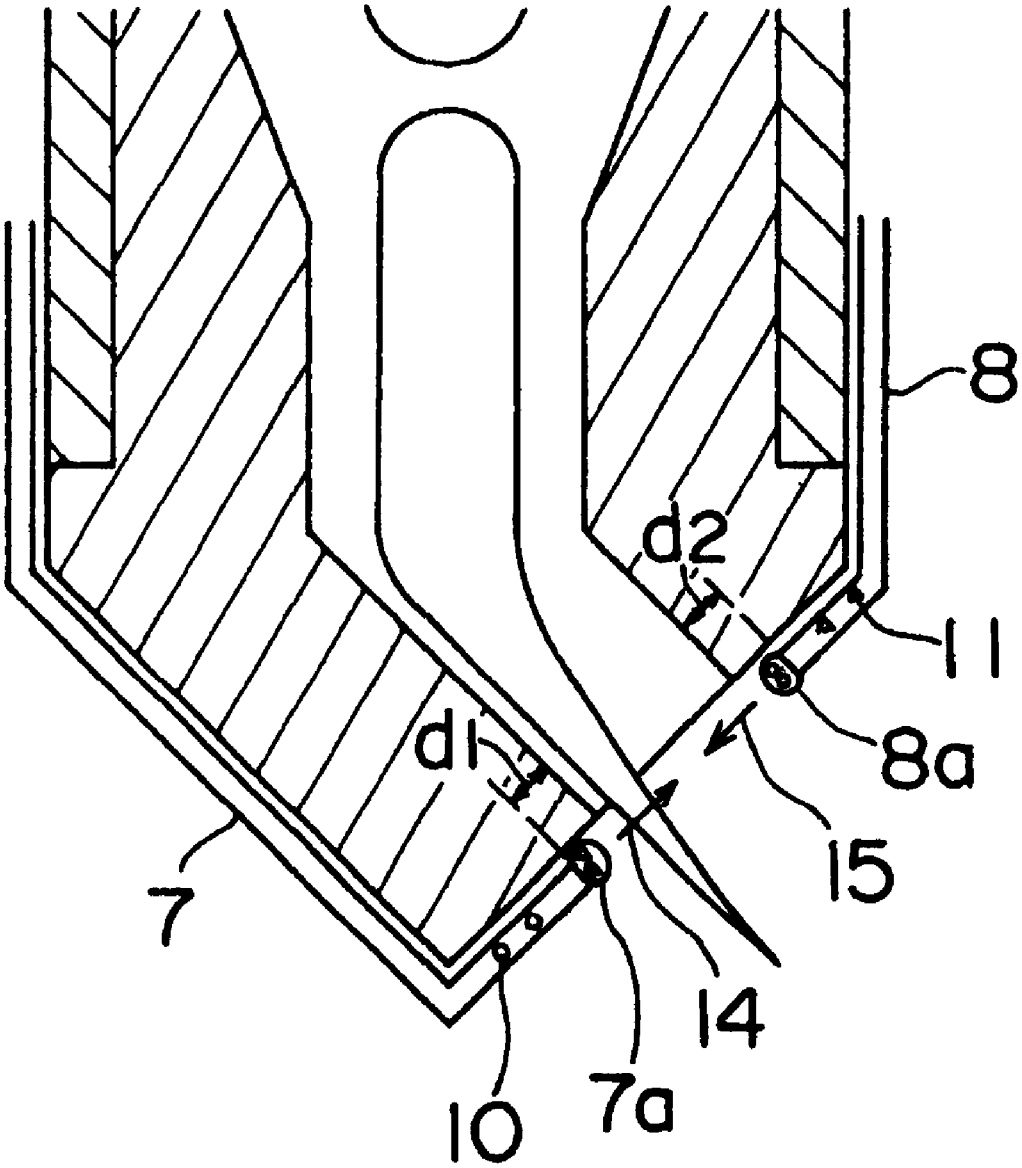
FIG. 10 is a schematic cross section showing a result obtained by carrying out the thermal spraying experiment in the state that the feeding ports of the powder-feeding tubes in the thermal spraying gun of a two line external feeding system are oppositely disposed.

In Example 2-2, $\alpha_2$ was fixed to 0°, and $\alpha_1$ was varied from 0 to 75° to prepare Samples 4 to 9. In Samples 4 to 9, film thickness measurement results of the films are shown in FIG. 8, and results obtained by determining a carbon steel rate in the film components by an area rate held by the carbon steel (black part) are shown in FIG. 9.

As $\alpha_1$ was increased, the film thicknesses and the carbon steel rates in the films were decreased to a large extent. This is due to that since the carbon steel to be molten was introduced into the plasma jet and decreased, a rate of the carbon steel held in the film was decreased, which in turn exerted an effect on the overall film thickness. Accordingly, considering stability of the film quality and a yield of the powder, $0° \leqq \alpha_1 \leqq 45°$ and $0° \leqq \alpha_2 \leqq 45°$ are preferred.

COMPARATIVE EXAMPLE 4

The bore thermal spray gun of a two line external feeding system (FIG. 1) of the present invention was used to feed a carbon steel powder from the high temperature 9*a* side of the thermal spraying flame 9 and an Al—Si base alloy powder from the low temperature 9*b* side of the thermal spraying flame 9 on the conditions shown in Table 3 to carry out a continuous thermal spraying experiment. In this case, $d_1$=2 mm, $d_2$=2 mm, $\alpha_1$=0° and $\alpha_2$=0° were set up.

After 90 minutes since starting continuous thermal spraying, both powder-feeding ports 7*a,* 8*a* were clogged. This was caused by that the powder fed passed through the plasma jet 6 and adhered to the vicinity of the other powder-feeding ports 8*a,* 7*a* positioned on the same line.

Although the present invention has been described with reference to the embodiments shown in the drawings, it is not limited to these embodiments. All modifications, changes, and additions that are easily made by a person skilled in the art are embraced in the technical scope of the present invention.

The disclosure of Japanese Patent Application 2000-185541 filed on Jun. 21, 2000 including the specification, the claims, the drawings, and the abstract is incorporated herein by reference with its entirety.

What is claimed is:

1. A mixed powder thermal spraying method comprising:

forming a plasma jet in a plasma jet passage of a thermal spraying body having an injection port at one end thereof for carrying out thermal spraying;

bending the plasma jet in a bent portion of the plasma jet passage so as to generate in the plasma jet a high temperature part and a low temperature part;

feeding a first material through a first powder-feeding tube and into the high temperature part of the plasma jet to a location where the plasma jet exits the thermal spraying body through the injection port by means of a first powder-feeding port communicating with the first powder feeding tube and arranged externally to the injection port and feeding a second material having a melting point lower than the melting point of the first material through a second powder-feeding tube into the low temperature part of the plasma jet to the location where the plasma jet exits the thermal spraying body through the injection port by means of a second powder-feeding port communicating with the second powder feeding tube and arranged externally to the injection port so as to form by means of the plasma jet a thermal spraying flame comprising the first material and the second material, the first material and the second material each being molten in the thermal spraying flame; and forming a mixed thermal spraying film comprising the first and second materials by directing the thermal spraying flame onto a surface;

wherein the first and second powder feeding tubes are disposed along a circumferential surface of the thermal spraying body; and wherein the first and second materials are separately controlled and fed to the plasma jet.

2. The method according to claim 1, in which:

$0° \leqq \alpha_1$ and $0° \leqq \alpha_2$ are set up; and wherein $\alpha_1$ is an angle made by an injection direction of the powder fed into the high temperature part of the plasma jet and a plasma jet-injecting face of an anode in a thermal spraying gun body, and $\alpha_2$ is an angle made by an injection direction of the powder fed into the low temperature part of the plasma jet and the plasma jet-injecting face of the anode in the thermal spraying gun body.

3. The method according to claim 2, wherein no further powder-feeding ports are located beyond the first and second powder-feeding ports along the injection direction.

4. The method according to claim 1, wherein:

the first material is an Fe base material;

the second material is an Al base material;

the Fe base material is externally fed into the high temperature part of the plasma jet; and the Al base material is externally fed into the low temperature part of the plasma jet.

5. The method according to claim 4, wherein the Al base material is selected from the group consisting of Al—Si base alloy, Al—Pb base alloy, Al-bronze alloy, Al—Cu base alloy, and pure Al.

6. The method according to claim 4, wherein the Fe base material is selected from the group consisting of white cast iron, carbon steel, Fe—Mo base alloy, Fe—Cr base alloy, and Fe—Ni base alloy.

7. The method according to claim 4, wherein the Al base material is an Al—Si base alloy powder having a particle diameter of from 10 $\mu$m to 105 $\mu$m.

8. The method according to claim 4, wherein the Fe base material is a carbon steel powder having a particle diameter of from 10 $\mu$m to 105 $\mu$m.

* * * * *